United States Patent [19]

Brorein

[11] 4,333,699

[45] Jun. 8, 1982

[54] FLAT TELEPHONE CORD PLUG IMPROVEMENTS

[75] Inventor: William J. Brorein, Whippany, N.J.

[73] Assignee: GK Technologies, Incorporated, Greenwich, Conn.

[21] Appl. No.: 74,136

[22] Filed: Sep. 10, 1979

Related U.S. Application Data

[63] Continuation of Ser. No. 870,586, Jan. 18, 1978, abandoned.

[51] Int. Cl.[3] ..... H01R 13/62

[52] U.S. Cl. ..... 339/61 M; 339/75 P; 339/91 R

[58] Field of Search ..... 179/1 PC; 339/61 R, 339/61 M, 91 R, 176 M, 99 R, 126 R, 184 RM, 186 PM, 75 P

[56] References Cited

U.S. PATENT DOCUMENTS

| | | | |
|---|---|---|---|
| 3,137,535 | 6/1964 | Collier et al. | 339/186 M X |
| 3,643,205 | 2/1972 | Elkins | 339/91 R |
| 3,846,736 | 11/1974 | Murz | 339/126 RS |
| 4,008,940 | 2/1977 | Foley | 339/91 R |
| 4,146,292 | 3/1979 | Garrett | 339/176 M X |

*Primary Examiner*—Eugene F. Desmond

*Attorney, Agent, or Firm*—Hopgood, Calimafde, Kalil, Blaustein & Judlowe

[57] ABSTRACT

This specification describes an improvement in miniature plugs that are used for connecting together a telephone handset to a jack in the base of a telephone, and for connecting the base to a wall outlet or jack. Such plugs, particularly when used for handset cords, are pulled and flexed during normal use, and this causes movement that results in damage to contacts in miniature plugs so that reception becomes progressively more noisy, and the miniature plug has to be eventually replaced. This invention provides an effective structure for eliminating the motion and the problem that the motion causes.

15 Claims, 16 Drawing Figures

FLAT TELEPHONE CORD PLUG IMPROVEMENTS

This application is a continuation of my application Ser. No. 870,586, filed Jan. 18, 1978 and now abandoned.

BACKGROUND OF THE INVENTION

Miniature plugs have been found to be economical and very useful for quickly and easily connecting together the telephone handset to its base and the base to the wall outlet or jack. However, a serious weakness has been found in particular with the plugs on handset cords that are pulled and flexed during normal use. This causes the plugs to move in the jacks at both the handset and the base ends of the connecting cord.

It has been demonstrated that this motion, even though it is very slight, causes, fretting, galling and pitting and erosion of the electrical contacts, and this leads to premature failure due to the electrical noise introduced into the circuit by the deteriorating contacts.

The failure mechanism is generally accepted to be as follows: The current flowing through the mated contacts is concentrated in a few small areas of high points on the contacting surfaces, even though the surfaces may be highly polished. The motion between these mated surfaces causes the current paths to be broken as the points are moved apart and the current is picked up at other high points which come into contact. The mechanical rubbing of the surfaces plus the electrical arcing which occurs as the current is broken at one point and picked up at another combine to cause rapid erosion of the contact surfaces. The arcing causes points to become welded together plus it causes metal vapors to be formed as the surface is burned away by the heat of the arc. The welded points are torn apart by the motion of the contact, thus leaving rough edges and metal fragments.

The arcing also polymerizes organic vapors that are normally found in the air, and these condense to further contaminate the contact surfaces with insulating films and particles. This debris of metal oxides, metal particles, organic material and combinations thereof accumulates between and around the contacting surfaces, thus interrupting the flow of current as the contacts are moved, and this generates electrical noise in the communication circuit. This noise can become so great that the instrument becomes useless.

Special precious metal platings, lubricants and the like have been used to delay the onset of moving contact failure; however, the only positive way to prevent this type of contact failure is to eliminate the motion between the contacting surfaces.

It is the purpose of this invention to prevent motion between the plug and jack contacts due to the forces from the cord while the phone is in use, and yet allow the plugs to be inserted and removed from the jacks without tools or special skills and to maintain the desired features of the plugs and jacks.

The invention uses a new plug which is of the miniature type used on telephone handset retractile cords. This new plug has "V" shaped ridge protrusions placed at strategic points around the periphery of the rear end of the plug; the rear end being the end where the cord enters the plug and the end which is last to enter the jack.

When the plug is pushed into the jack, these ridges are forced against the surrounding surfaces of the jack where the ridges lock the plug against side-to-side and up-and-down motion in the jack, but they do not prevent the plug from being pushed into or removed from the jack. Once the plug is inserted into the jack and then pulled back against the latch stop, there are only pulling forces exerted on the plug from the cord and therefore there is no tendency for the plug to be moved back and forth in the jack along their common axis. It is the side-to-side and up-and-down motions that must be contended with, and this is effectively done with the ridges on the plug.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
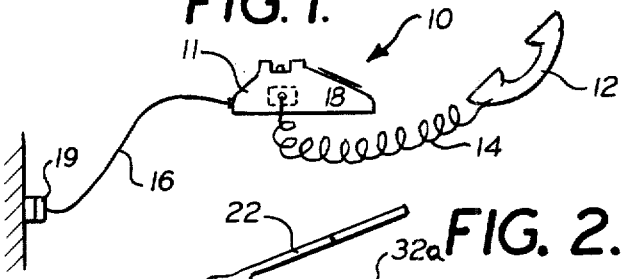
FIG. 1 is a diagrammatic view showing a telephone with a handset connected with the telephone base by a retractable telephone cord and showing the telephone connected with a wall jack by another telephone cable with which the present invention is used.

FIG. 1 shows a telephone 10 having a base portion 11 and a handset 12. The handset 12 is connected with the base portion by the usual coiled cord 14; and the base portion 11 is connected, by a cord 16. The cords 14 and 16 have plugs (not shown), one of which fits into a jack 18 in the base portion 11 and the other of which fits into a jack 19 by which the telephone is connected with the telephone company circuits.

Figure 2:
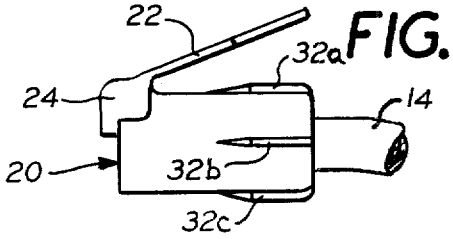
FIG. 2 is a side elevation of a plug by which a telephone cord can be connected with a jack in the base of a telephone or with a wall jack fitting.

FIG. 2 shows a miniature plug 20, which is greatly enlarged in the drawing for better illustration. The plug 20 connects with the cord 14 and has a latch 22 secured to the plug 20 by a connection 24; the latch 22 and the connection 24 constituting a part of the plug 20 in the preferred construction. All of these parts are made of plastic and the latch 22 is depressed toward the main body of the plug 20 as the plug is inserted into the jack. The latch 22 springs outward away from the body of the plug 20 when the plug is fully inserted into the jack and the latch engages behind other structure of the jack to prevent the plug 20 from being pulled out of the jack unintentionally.

Figure 3:
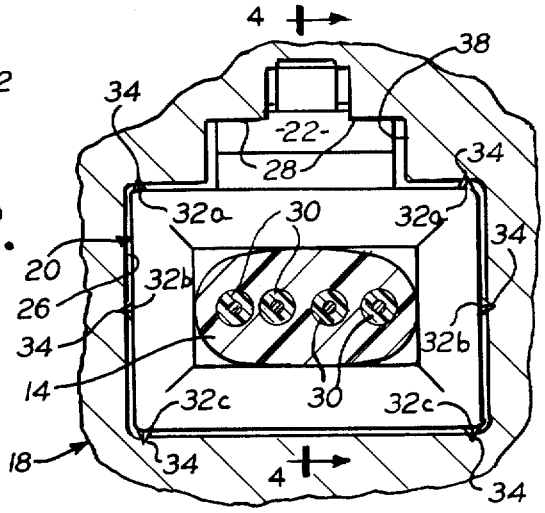
FIG. 3 is a greatly enlarged view of the right hand end of the plug shown in FIG. 2, and a fragmentary view of an opening in a telephone jack into which the plug is inserted.

FIG. 3 shows the plug 20 inserted into a socket 26 in the jack 18. The jack has shoulders 28 behind which the latch 22 engages to prevent the plug 20 from being pulled out of the socket 26.

The construction thus far described is well known and this invention relates to the construction of the plug 20 in such a way as to prevent relative movement of the plug in the socket 26. In the ordinary use of the telephone, the cord 14 is subjected to movement which causes the plug 20 to shift its position from time to time to the extent that it can do so as the result of clearances around the plug 20 in the socket 26 and at various other places within the jack 18.

With miniature plugs which may have a width of the order of 0.3 inches, the contacts are necessarily small and the contact areas are also small. Even very limited amounts of movement of the plug causes enough movement of the contacts carried by the plug and by the jack to cause excessive wear, sparking, and deteriorating circuit connections. Eventually, the miniature plugs of the prior art made such a noisy connection that they could no longer be used in the telephone.

The invention of this specification provides wedges on the plug 20 which hold the plug in the socket with sufficient wedging action to prevent movement of the plug in the jack socket and to prevent any consequential movement of the contacts which complete the circuits of the conductors in the cords 14 and 16 and the contacts of the telephone circuit beyond the plug 20.

In FIG. 3, the conductors in the cord 16 are indicated by the reference characters 30, and four such conductors are shown. The plug 20 has wedges, indicated by the reference characters 32*a*, 32*b* and 32*c*. These wedges, referred to generally as 32, are preferably part of the plug 20 and constitute protrusions extending outward from the flat surfaces of the plug 20. The cross-section of the plug 20, without the wedges 32, is preferably rectangular, and it fits within the socket 26 which is also rectangular and slightly larger in cross-section that the rectangular cross-section of the plug.

The wedges 32 extend outward from the flat sides of the plug for distances greater than the clearance between the corresponding, confronting rectangular surfaces of the plug 20 and socket 26.

In the preferred construction, shown in FIG. 3, the wedges 32 are of one-piece construction with the plug 20, and the wedges and plug are made of plastic material which is somewhat stiffer than the plastic material of which the jack 18 is made. Thus the insertion of the plug 20 into the socket 26 causes the wedges to displace material of the walls of the socket 26 by compressing the material of the wall immediately adjacent to the wedges 32. FIG. 3 shows the material of the socket wall 26 displaced by the wedges 32 and as indicated by the fact that the wedges 32 are shown extending somewhat beyond the surfaces of the walls of the socket 26. These depressions in the socket wall are indicated by the reference characters 34.

The projections 32 are distributed around the perimeter of the plug 20 in such a way as to hold the plug in a fixed position after it has been inserted into the socket, and the various wedges 34 have depressed spaced areas of the socket wall at such locations that the plug cannot rock or shift its position in the socket 26, even though the telephone cord 14 is subject to longitudinal and transverse displacements and consequent forces in those directions. In the preferred construction, shown in FIG. 3, there are two wedges 32*a* projecting from the top surface of the plug 20 at locations near opposite sides of the top surface. There are corresponding wedges 32*c* projecting from the bottom face of the plug 20 near its opposite sides. Other wedges 32*b* project from the opposite sides of the plug 20, preferably at locations midway between the top and bottom surfaces of the plug.

Figure 4:
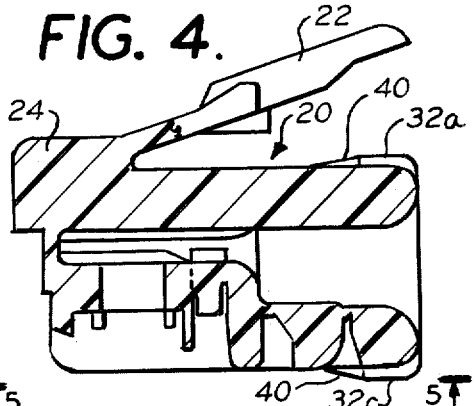
FIG. 4 is a sectional view taken on the line 4—4 of FIG. 3, showing the cord entering the plug but omitting all of the connections inside the plug for clearer illustration.

FIG. 4 is a sectional view taken on the line 4—4 of FIG. 3. It shows the interior of the plug 20 and the spaces into which the conductors 30 extend for connection with contacts along the underside of the plug for engaging with complementary contacts in the socket into which the plug 20 is inserted. These connections are not shown, nor is the cord 14 shown in FIG. 4, because none of the interior connections in the plug forms a part of this invention. The purpose of FIG. 4 is to show the right-hand wedges 32*a* and 32*c* of FIG. 3 in elevation. The connection 24 which joins the latch 22 to the plug 20 is shown in FIG. 4 as extending considerably higher than the wedge 32*a*; but reference to FIG. 3 will show that the connection 24 and latch 22 extend into space 38 at the top of the socket 26 which is of less width than the plug 20 or the socket 26, so that the portions of the socket that confront the wedges 32*a* are close to the plug 20 and in position to be depressed by the chisel edge of the wedges 32*a*.

In order to obtain the wedging action as the plug 20 is forced into the socket 26, there is a taper 40 at the forward end of the wedge 32*a* for depressing the confronting face of the socket 26 as the plug 20 is forced into the socket, moving toward the left in FIG. 4.

Figure 5:
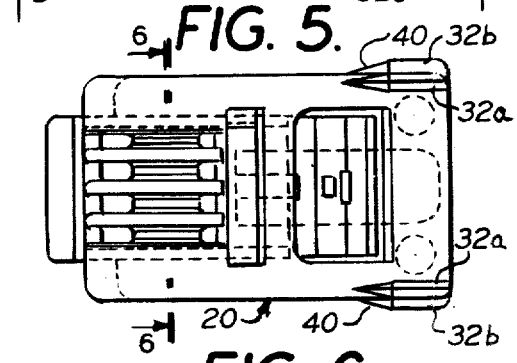
FIG. 5 is a bottom view of the plug shown in FIG. 4, the view being taken on the line 5—5 of FIG. 4.

FIG. 5 is a bottom view of the plug 20; and it shows the top plan view of each of the wedges 32*a* and a side elevation of each of the wedges 32*b* which are shown in FIG. 5 to be of similar shape to that of the wedges 32*a*.

Figure 6:
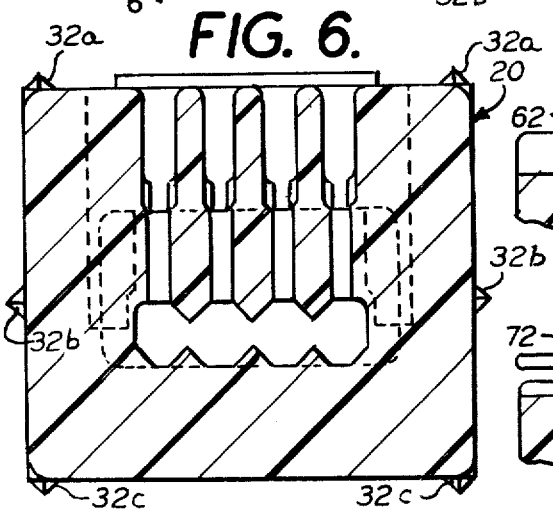
FIG. 6 is a sectional view taken on the line 6—6 of FIG. 5.

FIG. 6 is a sectional view taken on the line 6—6 of FIG. 5, and on a larger scale, for showing the pointed ends of all of the wedges 32*a*, 32*b* and 32*c*. FIG. 6 also shows the way in which the corners of the top, bottom and side surfaces of the plug 20 can be rounded off, in accordance with conventional molding practice, at locations beyond the various wedges 32. All of the wedges are of the same shape in the description thus far, but they may be of different shapes from one another or they may all be of the same shape but different from that shown in FIGS. 2–6.

FIGS. 7–16 show one of the wedges 32*a* on a larger scale, and alternate wedges.

Figure 9:
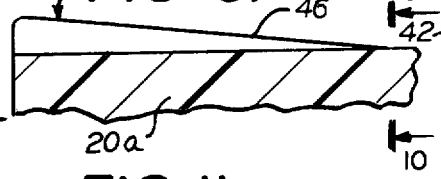
Figure 10:
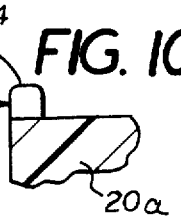

FIGS. 9 and 10 show another wedge 42 with a flat top 44 (FIG. 10) and with a sloping surface 46 which may extend for the full length of the wedge 42. This wedge 42 is preferably of one piece construction with the plug 20*a*, and it has a wider face for contacting with the confronting face of the socket, so that there is a larger area of contact with the top of the wedge 42 by the confronting socket surface, though somewhat less depression of the socket surface because of the reduced unit pressure.

Figure 7:
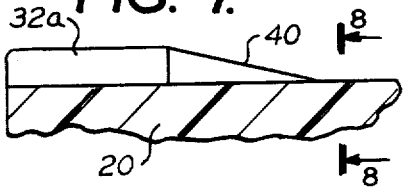
FIGS. 7, 9, 11, 13 and 15 are fragmentary detailed views showing the different forms of the wedges used on the side of the plugs, shown in the other views; these figures being side elevations of one of the protuberances.
Figure 8:
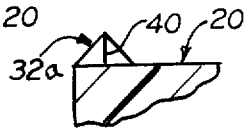
FIGS. 8, 10, 12, 14 and 16 are end views of the protuberances or wedges shown in FIGS. 7, 9, 11, 13, and 15, respectively.
Figure 11:
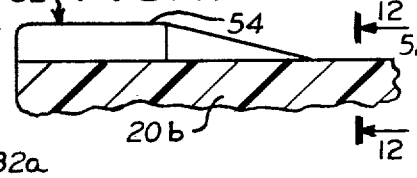
Figure 12:
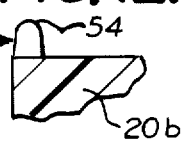

FIGS. 11 and 12 shows a modification of the structure shown in FIGS. 7 and 8. A wedge 52 has a rounded top surface 54 instead of the angular top surface shown in FIGS. 7 and 8. This contour distributes the clamping force against the socket wall over a larger area than in FIG. 8 but not as large an area as in FIG. 10. The wedge 52 is preferably of one-piece construction with its plug 20*b*; and the most desirable shape for the wedge depends to some extent on the relative hardness of the plug material as compared with the wall of the socket. It is essential that the force of the wedges against the walls of the socket be low enough to permit the plug to be inserted fully into the socket and at the same time have enough pressure between the wedges and the socket walls to prevent any movement of the plug with respect to the socket after it is in place and subject to the forces exerted by the cord 14 (FIG. 1) of the telephone handset.

Figure 13:
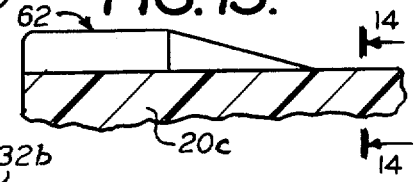
Figure 14:
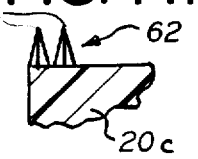

FIGS. 13 and 14 show a wedge 62 which is similar to that shown in FIGS. 7 and 8 but which is made as two triangular ridges instead of a single ridge as in FIGS. 7 and 8. These triangular ridges 64 yield more easily than the wide single ridge of FIG. 8, and each one exerts less pressure against the socket wall than in the case of the wedge 32*a* of FIG. 8, but it has two lines of contact instead of one and is suitable with harder socket material than are the other wedges.

Figure 15:
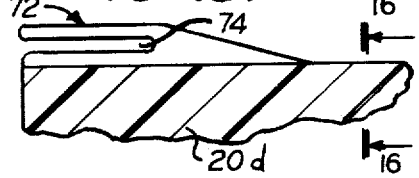
Figure 16:
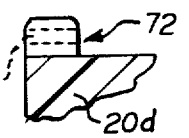

FIGS. 15 and 16 show another modified wedge 72 which is preferably of one-piece construction with its plug 20*d*. The wedge 72 has a flat top and has a slot 74 under the flat top and which is capable of flexing so that its flat top surface can maintain substantial friction contact with a socket wall and without much depression of the surface of the socket wall.

The total length of the wedge is preferably less than 50% the length of the plug and the length of the wedge in contact with the socket wall at least 20% of the length of the plug. The height of each wedge in the preferred miniature plug is about 0.010 inch, and of a width approximately twice the length; that is, 0.020 inch.

The preferred embodiments of this invention have been illustrated and described, but changes and modifications can be made and some features can be used in different combinations without departing from the invention as defined in the claims.

What is claimed is:

1. A telephone connection including a miniature plug for connecting telephone wires in an opening in a jack of the telephone handset or a wall jack that has an opening with side walls, said plug having a rearward end with an entrance opening therein for receiving a cord having a plurality of conductors therein, outlet openings near the other end of the plug for circuits from the conductors in the cord, protuberances normal to the longitudinal sides of the plug and at spaced positions around the perimeter of said plug, said protuberances having bases immovably secured to the plug immediately beneath them and being somewhat greater in height than a clearance between the walls of the plug and the walls of the opening in the jack into which the plug is intended to be inserted, said walls of the jack opening being in fixed relation to one another whereby the protuberances wedge the plug against movement in all directions transverse of the direction in which the plug is inserted into the opening in the jack.

2. The telephone connection described in claim 1 characterized by the connection including in combination a jack for connecting individual conductors of the plug with separate conductors of a telephone circuit, the jack having an opening for receiving the plug, each of said protuberances being of a height greater than a clearance between the plug and the opening in the jack into which the plug is inserted, so that the plug can be inserted into the opening in the jack only by some deformation of the protuberances and the wall of the opening in the jack, said protuberances serving as wedges for holding the plug and any electrical contacts carried by the plug against transverse movement with respect to the sides of the opening in the jack and any electrical contacts carried by the jack.

3. The telephone connection described in claim 2 characterized by the protuberances being wedges with bases that are of unitary construction with the plug and with the the point of the wedge projecting toward a confronting surface of the side of the opening in the jack and extending from the rearward end of the plug for a substantial distance lengthwise of the opening into which the plug is inserted.

4. The telephone connection described in claim 3 characterized by the wedges extending lengthwise of the plug and tapering down to a level of the outside surface of the plug at the forward end of each of the wedges.

5. The telephone connection described in claim 4 characterized by each wedge being of substantially uniform height along the part of the length of the plug leading for a substantial distance from the rearward end of the plug to the region where the wedge begins to taper downward toward the outside surface of the plug.

6. A telephone connection including a miniature plug for connecting telephone wires in a jack of a telephone handset or a wall jack, said plug having a rearward end with an entrance opening therein for receiving a cord having a plurality of conductors therein, outlet openings near the other end of the plug for circuits from the conductors in the cord, protuberances normal to the longitudinal sides of the plug and positioned around the perimeter of said plug, said protuberances having bases integrally secured to the plug and being somewhat greater in height than a clearance between the walls of the plug and the walls of an opening through a telephone jack into which the plug is intended to be inserted, for wedging the plug against transverse movement in the opening through a telephone jack, and characterized by the connection including in combination a jack for connecting individual conductors of the plug with separate conductors of a telephone circuit, the jack having an opening for receiving the plug, each of said protuberances being of a height greater than a clearance between the plug and the opening in the jack into which the plug is inserted, so that the plug can be inserted into the opening in the jack only by some deformation of the protuberances and the wall of the opening in the jack, said protuberances serving as wedges for holding the plug and any electrical contacts carried by the plug against transverse movement with respect to the sides of the opening in the jack and any electrical contacts carried by the jack and further characterized by each protuberance being of one-piece construction with the plug and the opening in the jack having walls confronting the surfaces of the plug and substantially parallel to the confronting surfaces of the plug, the material of the plug being stiffer than the walls of the jack opening, so that the protuberances of the plug form depressions in the walls of the jack opening for holding the plug against movement in the opening in the jack.

7. The telephone connection described in claim 4 characterized by the length of the protuberances being less than one-half the length of the plug.

8. The telephone connection described in claim 4 characterized by width of the bases of the wedges being at least twice the height of the wedges.

9. The telephone connection described in claim 2 characterized by said wedge-developing protuberances being adjacent to the corners of opposite sides of the plug and projecting from said opposite sides, and further characterized by further wedge-developing protuberances projecting from other sides of the plug at locations approximately midway between said opposite sides.

10. The telephone connection described in claim 2 characterized by the wedge-producing protuberances being of triangular transverse cross-section.

11. The telephone connection described in claim 10 characterized by the wedges including two wedge-producing protuberances of triangular cross-section adjacent and parallel to one another and extending from the same plug surface near a corner of the plug.

12. The telephone connection described in claim 2 characterized by the wedge-producing protuberances being of substantially rectangular cross-section and having a substantially flat top that contacts with a confronting surface of the opening in the jack.

13. The telephone connection described in claim 2 characterized by the wedge-producing protuberances having substantially straight and generally parallel sides extending upward from a surface of the plug and having top surfaces that are curved and of greatest height at regions substantially midway between the straight sides of the wedge.

14. The telephone connection described in claim 2 characterized by the plug and the jack opening being rectangular in cross-section with their width greater than their height, the protuberances extending lengthwise of the plug and for a substantial part of the length of the plug and substantially at right angles to the rearward end of the plug, there being two protuberances near opposite sides of the wider sides of the plug facing away from said wide sides, and a single protuberance projecting from each of the shorter sides of the plug at a location midway between the top and bottom sides of the plug.

15. The telephone connection described in claim 1 characterized by each of the wedge-producing protuberances having a slot therein substantially parallel to the surface of the plug and extending for a portion of the length of the protuberance, the portion of the protuberance above the slot being deflectable and resilient for exerting a spring-like pressure outward, away from the plug, when the plug is inserted in the opening in the jack.

* * * * *